United States Patent [19]

Kholin

[11] Patent Number: 4,646,709

[45] Date of Patent: Mar. 3, 1987

[54] BALL THROWING MACHINE

[75] Inventor: Boris G. Kholin, Sumy, U.S.S.R.

[73] Assignee: Sumsky Filial Kharkkovskogo Politekniceskogo Instituta, Sumy, U.S.S.R.

[21] Appl. No.: 878,969

[22] PCT Filed: Feb. 28, 1985

[86] PCT No.: PCT/SU85/00018

§ 371 Date: May 9, 1986

§ 102(e) Date: May 9, 1986

[87] PCT Pub. No.: WO86/02010

PCT Pub. Date: Apr. 10, 1986

[30] Foreign Application Priority Data

Sep. 28, 1984 [SU] U.S.S.R. ..... 3791133

[51] Int. Cl.[4] ..... A63B 69/40

[52] U.S. Cl. ..... 124/82; 124/1; 124/50; 124/51 R

[58] Field of Search ..... 124/1, 6, 7, 16, 45, 124/49, 50, 51 R, 54, 82

[56] References Cited

U.S. PATENT DOCUMENTS

| | | | |
|---|---|---|---|
| 702,415 | 6/1902 | Edwards | 124/51 R X |
| 2,057,599 | 10/1936 | Serrano | 124/82 X |
| 2,660,158 | 11/1953 | Binks | 124/50 X |
| 3,084,833 | 4/1963 | Kline et al. | 124/82 X |
| 3,094,112 | 6/1963 | Dahlstrom | 124/82 X |
| 3,570,466 | 3/1971 | White et al. | 124/50 X |
| 3,610,223 | 10/1971 | Green | 124/50 X |
| 3,779,227 | 12/1973 | Scott | 124/50 X |

FOREIGN PATENT DOCUMENTS

| | | | |
|---|---|---|---|
| 2556278 | 6/1977 | Fed. Rep. of Germany | 124/54 |
| 1520776 | 12/1977 | Fed. Rep. of Germany . | |
| 7306178 | 9/1974 | France . | |
| 13934 | 2/1977 | Japan | 124/50 |
| 315851 | 8/1930 | United Kingdom | 124/50 |

OTHER PUBLICATIONS

International Application published under the Patent Cooperation Treaty-PCT/US81/00739.

*Primary Examiner*—Paul E. Shapiro

*Attorney, Agent, or Firm*—Lilling & Greenspan

[57] ABSTRACT

A ball throwing machine comprises a pipe (4) for supplying balls (5) and an impeller (9) with a hammer (10) fitted on a drive shaft (8). There is provided a follower (11) to which are cantilevered two support tabs (15) adapted to receive and retain the ball (5). The support tabs (15) are spaced from each other at a distance smaller than the diameter of the ball (5) and greater than the width of the hammer (10) of the impeller (9) and positioned in such a manner as to let the hammer (10) of the impeller (9).

4 Claims, 3 Drawing Figures

BALL THROWING MACHINE

TECHNICAL FIELD

The invention relates to apparatus designed for sports training purposes, and more particularly, it deals with a ball throwing machine.

BACKGROUND OF THE INVENTION

Known in the art is a ball throwing machine (cf. French Pat. No. 2218113, Int.Cl. A 63 B 69/38, 1974), comprising a base, a distributor mounted on the base and designed for a successive supply of balls and also a drive shaft and an impeller with a hammer installed on the drive shaft and designed to strike the ball with the hammer.

The impeller is installed on the drive shaft which is operatively connected to a drive for rotating the impeller in a plane extending at right angles to the shaft axis.

An inclined trough is provided adjacent to the outlet port of the distributor and a follower in the form of a plunger which is designed for feeding a ball from the inclined trough of the distributor to the path of rotation of the impeller so as to strike the ball.

The follower is connected to the impeller by means of a timing mechanism for synchronizing movement of the follower and impeller so as to ensure the feeding of a ball by the follower to the path of rotation of the impeller at an appropriate time moment.

By varying the speed of the shaft with the impeller, the initial velocity of ball projection may be changed.

The prior art ball throwing machine may be effectively used for throwing balls in many applications. It should be, however, noted that in such ball throwing machine a ball is not fixed in the projection position after it has been moved by the follower to the path of rotation of the impeller. Because of the absence of ball retaining at a strictly predetermined point which is most favourable for striking the ball, balls may be hit by the impeller in such a manner as to have various random trajectories and initial velocities.

This is due to the fact that balls have somewhat different resilience and size and the follower speed may be subjected to random fluctuations. Therefore, the direction of projection of balls and their velocity may change arbitrarily during operation of the prior art ball throwing machine. This is not always desirable.

This is especially undesirable in applications where beginners or, the other way round, highly skilled players are to be trained, as well as in simulating champion's strokes, although it might prove desirable in certain applications to use such method of unstable ball throwing, e.g. when it is desirable to have a random nature of projection.

It should also be noted that the random pattern of ball projection practically does not ensure ball projection to various pre-set points of the tennis court at a pre-set velocity. Inaccurate hit of the impeller hammer at the ball results in an increased power consumption by the drive.

DISCLOSURE OF THE INVENTION

The main object of the invention is to provide a ball throwing machine in which the follower is so constructed as to ensure a stable projection of balls in a desired direction and at a pre-set velocity.

These objects are accomplished in a ball throwing machine, comprising a ball supply pipe connected to the base, an impeller with a hammer mounted on a drive shaft supported by the base for imparting angular motion to the impeller in a plane extending transversely with respect to the drive shaft, a follower connected to the base and designed for moving balls fed from the pipe toward the position for projection, the follower being operatively connected to the impeller for their timed movement, wherein, according to the invention, the follower has on the side thereof facing toward the impeller at least two support tabs secured to the follower, the free ends of the tabs being directed toward the outlet end of the pipe and adapted to receive and retain a next ball, and for that purpose the support tabs are spaced from each other at a distance smaller than the ball diameter and greater than the width of the impeller hammer and positioned in such a manner as to let the impeller hammer pass therebetween.

The provision of the two support tabs according to the invention, which define a space open on the side of the outlet port of the pipe makes it possible to ensure an accurate retaining (fixing) of a ball relative to the follower and then to move it accurately into the projection zone without disrupting the relative position of the ball and follower.

Therefore, each ball can be received in the space defined by the follower and two support tabs and moved at an appropriate time moment by the follower into a position the most favourable for striking the ball by the impeller hammer.

The arrangement of the support tabs defining the space for a ball in a position spaced from each other at a distance smaller than the ball diameter makes it possible to prevent the ball from falling therebetween in a simple and reliable manner, i.e. it enables the ball to be held in the most favourable position for the projection.

At the same time, the installation of the support tabs defining the space for a ball at a distance from each other greater than the width of the impeller hammer permits the hammer to pass therebetween so that the hammer can strike the ball accurately after the ball has been moved by the follower into the projection zone.

High accuracy of blow delivered at the ball by the hammer is achieved independent of the degree of ball wear and its resilience, hence random projection pattern is avoided which is very important for training.

The support tabs are preferably made in the form of leaf springs, and the free ends of the tabs are supported by the pipe adjacent to the outlet end thereof when the following ball is supplied from the pipe to the support tabs.

The provision of the support tabs in the form of leaf springs makes it possible to ensure a more reliable retaining of the ball thus contributing to an improved accuracy of ball projection and minimizing possibility of occurrence of random pattern of ball projection.

The follower is preferably made in the form of an arm having its pivot pin mounted on the base in parallel with the drive shaft.

This arrangement makes it possible to effect the desired movement of a ball into a position favourable for the blow with minimum applied force since the resistance of the arm to rotation about the pivot pin is very low.

A shut-off plate is preferably provided at the free end of the arm extending transversely with respect thereto and directed away from the support tabs for retaining the following ball within the pipe when the next ball is on the support tabs in the projection position.

The provision of such shut-off plate at the free end of the follower makes it possible to retain following balls within the pipe when the next ball is in the position before the projection.

Therefore, the ball throwing machine according to the invention ensure high accuracy of ball projection in a pre-set direction with both high and low velocity so as to enable simulation of individual strokes and combinations of strokes.

The ball throwing machine according to the invention is reliable in operation and is rather economical since the drive consumes minimum energy owing to the fact that a blow is practically always delivered at the ball with the most favourable relative position of the hammer and ball.

A specific embodiment of the invention will be given below with reference to the accompanying drawings.

BEST MODE FOR CARRYING OUT THE INVENTION

Figure 1:
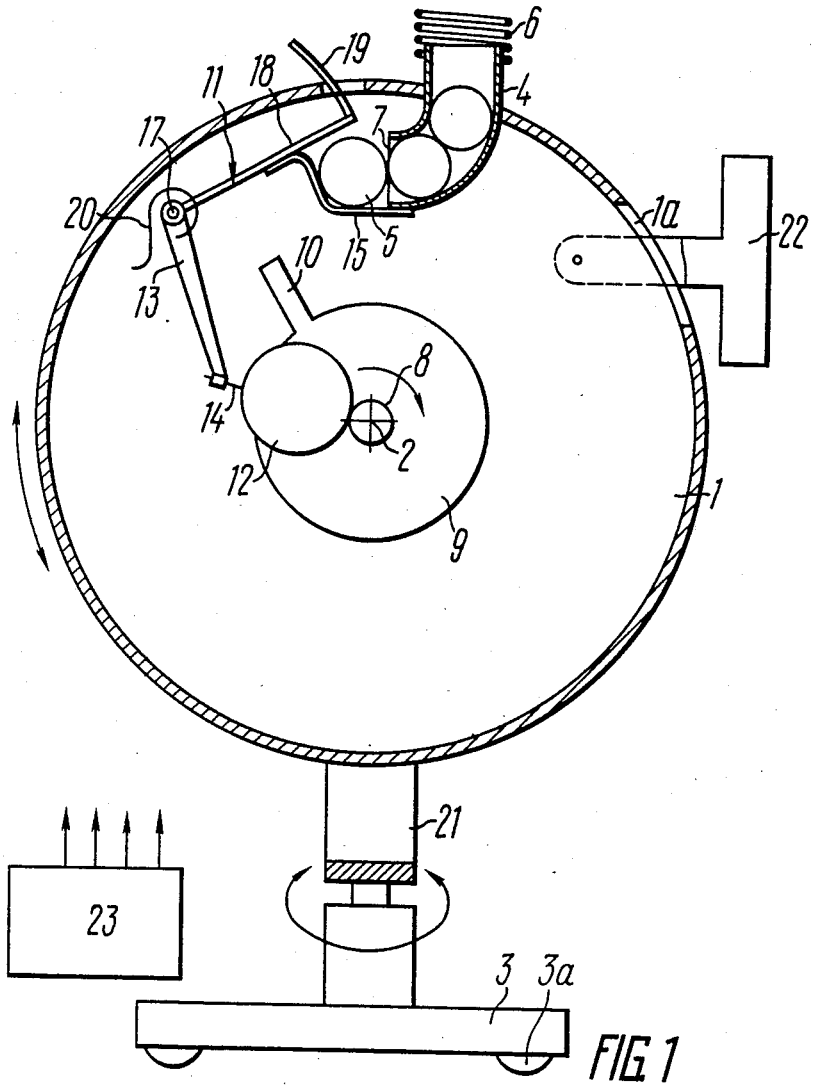
FIG. 1 schematically shows a ball throwing machine according to the invention, a longitudinal section; the follower is shown in the position when a ball supplied from the pipe has just entered the space between the support tabs and follower and is ready to move into the projection zone.

A ball throwing machine according to the invention has a casing 1 (FIG. 2) in the form of a hollow cylinder with a longitudinal axis 2 extending at right angles with the plane of drawing.

The casing 1 is installed on a base 3 which is in the form of a trolley shown with the same reference numeral 3 and which has wheels 3*a* for moving the ball throwing machine over a sports ground (not shown).

A pipe 4 for supplying balls 5 is installed in the top part of the casing 1 as shown in the drawing. A port 1*a* for the projection of the balls 5 is made in the top part of the casing 1. The pipe 4 comprises an elbow pipe as shown in FIG. 1. The unreferenced top inlet end of the pipe 4 as shown in FIG. 1 is connected to a distributor 6 which is arranged outside the casing 1.

The distributor 6 is designed for receiving the balls 5 from a magazine of any appropriate known type (not shown). The distributor 6 is made of a helical spring which is necessary to ensure a permanent communication of the magazine with the pipe 4 when the casing 1 is in any position.

The lower outlet end 7 of the pipe 4 as shown in FIG. 1 is arranged inside the casing 1 and is designed to supply the balls 5 from the pipe 4 into the interior of the casing 1.

A shaft 8 is installed in the casing 1 to extend along its longitudinal axis and is operatively connected to a drive (not shown) in the form of a variable speed electric motor that may be of any appropriate known type.

The shaft 8 is journalled in the casing 1 by means of bearings (not shown) that may be of any appropriate known type.

An impeller 9 is rigidly fitted on the shaft 8 and is in this case in the form of a disc having on its periphery a hammer 10 in the form of a rectangular parallelepiped.

The shaft 8 is designed to impart angular motion to the impeller 9 in a plane extending transversely with respect to the drive shaft 8.

The ball throwing machine according to the invention also has a follower 11 installed in the casing 1 which is designed for moving the balls 5 supplied from the pipe 4 into a position for projection. The follower 11 is operatively connected to the hammer 9 for their timed movement by means of a synchronizing mechanism 12 of any appropriate known type.

The follower 11 is connected to the synchronizing mechanism 12 by means of an arm 13 and a pullrod 14.

Two support tabs 15 are secured to the follower 11 on the side facing toward the hammer in the cantilevered fashion, the free ends 16 (FIG. 3) of the tabs being directed toward the outlet end 7 of the pipe 4 and being designed for receiving and retaining a next ball 5.

Figure 3:
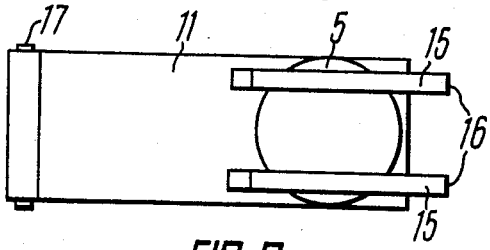
FIG. 3 is a view along arrow A in FIG. 2; only the follower carrying the ball on its support tabs is shown.

For that purpose, the support tabs 15 are spaced from each other at a distance smaller than the diameter of the ball 5 so as to prevent the ball 5 from falling down therebetween and greater than the width of the hammer 10 of the impeller 9 so as to let the hammer 10 of the impeller 9 so as to let the hammer 10 pass therebetween to deliver the blow, the tabs being positioned in such a manner that the hammer 10 can pass therebetween. The arrangement of the support tabs 15 on the follower 11 is shown in FIG. 3.

The support tabs 15 are made in the form of leaf springs. The free ends 16 of the support tabs 15 are supported, at the moment when a next ball is received from the pipe 4, by the pipe 4 adjacent to the outlet end 7 thereof as shown in FIG. 1.

It should be noted that, owing to the elastic deformation of the support tabs 15, the distance between them and the follower 11 becomes greater than the diameter of the ball 5 so that the ball can freely pass through to the position shown in FIG. 1.

The follower 11 is made in the form of an arm also designated with reference numeral 11, having its pivot pin 17 (FIGS. 1, 2) secured by known means to the casing 1 and extending in parallel with the shaft 8.

Figure 2:
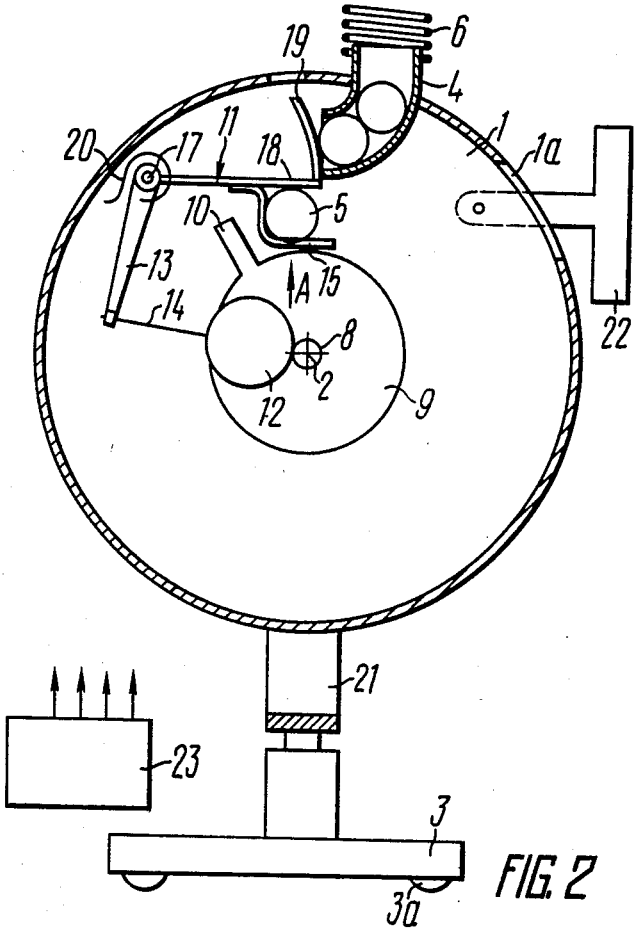
FIG. 2 is ditto, but the ball has been moved by the follower into the projection zone.

With this arrangement, when the follower 11 rotates clockwise about the pivot pin 17, as shown in FIG. 1, the ball 5 is moved to the position for projection as shown in FIG. 2.

A shut-off plate 19 is provided on the free end 18 (FIGS. 1, 2) of the follower 11 to extend transversely with respect to the arm 13, the plate being directed away from the support tabs 15 and adapted to retain the following balls 5 within the pipe 4 when the follower 11 is in the position shown in FIG. 2 and one of the balls 5 is in the position before projection.

A spring 20 (FIGS. 1, 2) is put on the pivot pin of the follower 11 and has one end thereof secured to the arm 13, the other end of the spring being secured to the casing 1 by any appropriate known means. The spring 20 is designed to move the follower 11 and ball 5 from the position shown in FIG. 1 to the position before projection shown in FIG. 2.

The ball throwing machine according to the invention also has a double-arm bracket 21 (FIGS. 1, 2) of any known type in which the casing 1 is installed for rotation about both vertical and horizontal axes.

This facility makes it possible to vary trajectories of the balls and direction of their projection during operation of the ball throwing machine by turning the casing 1 about vertical and horizontal axes.

For imparting a spin to the balls, there is provided a means for imparting spin to the balls which may be of any appropriate known type and which is installed adjacent to the ball port 1*a* in the casing 1.

There is provided a programmed control device 23 of any known type which is connected to the controls of the ball throwing machine by any appropriate known means, e.g. by cables, which will not be described in detail herein because they do not have any material bearing on the invention.

Rotation of the casing about vertical and horizontal axes and the provision of the programmed control device 23 make it possible to program ball projection in desired directions and to simulate complicated game conditions.

The ball throwing machine according to the invention function in the following manner.

The base 3 is moved over a tennis court on wheels 3*a* and installed in a desired place.

The drive connected to the shaft 8 is turned on, and the shaft, together with the impeller 9 and hammer 10, starts rotating at a pre-set substantially constant speed which may be varied as desired. It should be noted that the hammer 10 moves along a circle at a pre-set circumferential velocity.

Concurrently with the drive of the shaft 8, the synchronizing mechanism 12 comes into play which, through the intermediary of the pull rod 14 and arm 13, causes the follower 11 to turn about the pivot pin 17 into the upmost position as shown in FIG. 1. The spring 20 is thus wound-up.

At the same time, during rotation of the follower 11 into the upmost position, the support tabs 15 which are in the form of leaf springs will bear against the pipe 4 and, owing to their elastic deformation, the distance between them and the follower 11 increases and becomes greater than the diameter of the ball 5.

The ball 5 will pass freely under gravity into the space between the support tabs 15 and the follower 11 as shown in FIG. 1.

Subsequently, after a pre-set time interval determined by the operation cycle of the synchronizing mechanism 12, the mechanism 12 will cease pulling the pull rod 14 and will release it, and the follower 11, together with the ball 5, will move under the action of the spring 20 during a time shorter than one revolution of the impeller 9 into a position favourable for the hammer 10 to strike the ball 5 as shown in FIG. 5.

The synchronizing mechanism 12 will release the pull rod 14 at the time moment when the hammer 10 is under the pipe 4, and the force of the spring 20 is chosen such that the follower 11 with the ball 5 should have time to move from the position shown in FIG. 1 to the position shown in FIG. 2.

The shut-off plate 19 shuts-off the outlet of the balls 5 from the pipe 4 until the follower 11 is in the strike position.

At the next moment the hammer 10 will pass freely between the support tabs 15 and strike the ball 5.

As a result of the blow, the ball 5 will be projected through the port 1*a* of the casing 1 at a velocity which is 1.5–1.75 times higher than the velocity of the hammer 10. The ball 5 emerging through the port 1*a* will engage the device 22 for imparting spin to the ball, and the ball will be spun in the desired direction.

Subsequently, during further rotation of the hammer 10, the programmed control device 23 will turn the casing 1 in a desired manner about vertical and horizontal axes, change the hammer speed and operation cycle of the synchronizing mechanism 12 if necessary and also the setting of the device 22 for imparting spin to the balls.

Upon rotation of the casing 1, the distributor 6 for supplying balls 5, which is in the form of a helical spring, will expand or contract so as to enable free rotation of the casing 1.

Subsequently the synchronizing mechanism 12 will again pull the pull rod 14 to turn the follower 11 by means of the arm 13 about the pivot pin 17 to the position shown in FIG. 1, and the next ball 5 will get from the pipe 4 into the space between the support tabs 15 and the follower 11 as shown in FIG. 2, whereafter the next blow will be delivered at the ball 5 by the hammer 10 as described above.

The shots will follow one after another in a succession at a pre-set rate.

The ball throwing machine may have a remote control device (not shown) of any appropriate known type so as to permit a player to enjoy self-training.

A pilot sample of the ball throwing machine was made and successfully tested in training tennis players and hockey goalkeepers.

It should be emphasized that, owing to the abovedescribed structure of the follower having the support tabs, and thanks to a rapid and accurate positioning of the ball in the strike position, a stable projection of balls in desired directions and at high projection velocities is achieved which could be only so far achieved with the use of powerful pneumatic projectors.

The ball throwing machine according to the invention is rather highly reliable, simple and inexpensive in manufacture.

Therefore, the ball throwing machine according to the invention can project balls in desired directions at various velocities and varying degrees of spin in accordance with a pre-set program compiled by a coach or a player himself. The parameters of ball flight, the initial velocity and direction of flight, shot rate, velocity and direction of ball spin may be simulated to represent replica of champion's strokes and may even considerably outperform such strokes in parameters which is especially important for a rapid increase in the sports skill of tennis players.

In addition to stationary models of the ball throwing machine, the machine may also be manufactured in the form of a light-weight portable model. Such machine, which is simple and handy and yet inexpensive, may be easily transported in a car trunk or on a motorcycle, and the machine drive may be supplied by a car or motorcycle storage battery so as to permit training to be performed in the field, in the forest or at the beach or elsewhere provided there is a small ground available for the installation of the machine.

INDUSTRIAL APPLICABILITY

The ball throwing machine according to the invention may be advantageously used for training tennis, football and hockey players.

The ball throwing machine according to the invention may also be used for training in other games with balls (basketball, volleyball, handball).

I claim:

1. A ball throwing machine comprising a ball (5) supply pipe (4) connected to a base (3), an impeller (9) with a hammer (10) mounted on a drive shaft (8) supported by the base (3) for imparting angular motion to the impeller (9) in a plane extending transversely with respect to the drive shaft (8), a follower (11) connected to the base (3) and designed for moving balls (5) fed from the pipe (4) toward the position for projection, the follower (11) operatively connected to the impeller (9) for their timed movement, characterized in that the follower (11) has on the side thereof facing toward the impeller (9) at least two support tabs (15), the free ends (16) of which being directed toward the outlet end (7) of the pipe (4) and adapted to receive and retain a next ball (5), and for that purpose the support tabs (15) are spaced from each other at a distance smaller than the ball (5) diameter and greater than the width of the hammer (10) of the impeller (9) and positioned in such a manner as to let the hammer (10) of the impeller (9) pass therebetween.

2. A machine according to claim 1, characterized in that said support tabs (15) comprise leaf springs, the free ends (16) of the tabs bearing against said pipe (4) adjacent to the outlet end (7) thereof at the moment when the next one of said balls (5) is supplied from said pipe (4) to said two support tabs (15).

3. A machine according to claim 1, characterized in that said follower (11) comprises an arm having a pivot pin (17) mounted on said base (3) in parallel with said shaft (8).

4. A machine according to claim 3, characterized in that a snut-off plate (19) is provided on the free end (18) of the arm (13) to extend transversely with respect to the arm (13), the plate (19) being directed away from said two support babs (15) and being adapted to retain the following one of said balls (5) within said pipe (4) when said next ball (5) is retained on said two support tabs (15) in the position for projection.

* * * * *